US005191692A

United States Patent [19]

Pacione

[11] Patent Number: 5,191,692

[45] Date of Patent: Mar. 9, 1993

[54] CARPET JOINTING METHOD

[75] Inventor: Joseph R. Pacione, Thornhill, Canada

[73] Assignee: Tac-Fast Systems SA, Switzerland

[21] Appl. No.: 663,006

[22] Filed: Mar. 1, 1991

[51] Int. Cl.[5] ..... B31F 5/00

[52] U.S. Cl. ..... 29/423; 29/450; 156/249; 156/304.4

[58] Field of Search ..... 156/247, 304.4, 249, 156/344; 29/423, 450, 521; 428/86, 100, 223; 24/442, 443, 444, 446, 448, 451

[56] References Cited

U.S. PATENT DOCUMENTS

| | | | |
|---|---|---|---|
| 3,413,678 | 12/1968 | Krantz | 428/100 |
| 3,660,191 | 5/1972 | Shimota et al. | 156/304.4 |
| 3,711,349 | 1/1973 | Snyder et al. | 156/304.4 |
| 3,866,267 | 2/1975 | Poletti | 428/86 |
| 4,536,244 | 8/1985 | Greci et al. | 156/304.4 |
| 4,716,065 | 12/1987 | McLaughlin | 428/100 |
| 4,755,401 | 7/1988 | Friedrich et al. | 428/100 |
| 4,769,895 | 9/1988 | Parkins | 29/450 |
| 4,822,658 | 4/1989 | Pacione | 428/100 |
| 4,857,371 | 8/1989 | McClintock | 428/36.5 |
| 4,909,833 | 3/1990 | Adell | 156/247 |

FOREIGN PATENT DOCUMENTS

| | | | |
|---|---|---|---|
| 1174639 | 12/1969 | United Kingdom | 156/79 |

*Primary Examiner*—Michael W. Ball
*Assistant Examiner*—Steven D. Maki
*Attorney, Agent, or Firm*—Brian W. Gray; John C. Hunt

[57] ABSTRACT

When forming joins between carpet pieces in laying carpet, pile may be brushed into its proper orientation at the joins by pulling a brushing tape upwardly through the join between the carpet pieces. The brushing tape may be provided as a cover for adhesive carpet tape or for carpet tape having draft of a hook and loop fastening system. A pull string may also be provided for the brushing tape.

13 Claims, 4 Drawing Sheets

CARPET JOINTING METHOD

BACKGROUND OF THE INVENTION

1. Field of the Invention

This invention relates to a method of making neat seams between abutting edges of carpet pieces.

2. Background of the Invention

Conventional carpet may comprise one or more pieces cut to cover a selected area. If the area is large, two or more carpet pieces may be joined together to make a sheet sufficiently large to cover the area. Seams of such carpet are conventionally joined by stitching or by adhesive tape such as hot melt tape. The perimeter of the carpet may be fixed in position, for example by strips of wood nailed or glued to the floor and having upstanding spikes to penetrate the carpet lower surface and hold it in position.

In the conventional carpet laying procedures, the edges of two pieces of carpet which are to abut one another are frequently joined together using adhesive carpet tape. Great care must be taken, especially when pile carpet is being laid, that the seam between the two pieces of carpet is not impaired by extraneous matter in the seam. Such extraneous matter might be loose threads, carpet fragments, or other detritus It is particularly difficult to avoid small amounts of pile being turned downwardly to be caught in the seam thereby damaging the continuous surface of pile on the upper side of the carpet and also impairing the perfection of the joint between the carpet edges.

The installation system for carpet described and claimed in U.S. Pat. No. 4,822,658 to Pacione and issued Apr. 18, 1989 may mitigate to some extent the difficulties which arise in the use of adhesive tape. The system of U.S. Pat. No. 4,822,658 utilizes a hook and loop fastening system. One half of the fastening system, e.g. the looped half, is on the carpet backing and the other half, e.g. the hooked half, may be applied to the substrate as a tape around the margins of the area over which the carpet is to be laid and along the seams of the carpet if more than one piece of carpet is required to cover the area. There is discussion in the disclosure of that patent of a temporary cover for the tape which carries the hooked half of the fastening system. The temporary cover may be paper or other material and is provided for the purpose of preventing premature fastening of the hook and loop fastening system or to prevent or lessen the catching of the hooks in the carpet pile.

At least some of the advantages of a hook and loop fastening system over adhesive tape or other fastening systems may be due to the releasable bond that it forms. If, for example, after laying of a carpet, it is noticed that the seam between two carpet pieces is impeded, the bond may be loosened and the offending impediment, e.g. thread or other detritus may be removed, or the offending pile may be straightened. Thereafter the fastening may be reinstated. Nevertheless, difficulties may still be encountered in preventing pile strands impairing the seam, and correction of such impairments may be a slow and time consuming task.

SUMMARY OF THE INVENTION

It has now been discovered that the problem of preventing pile coming between carpet edges may be prevented by a startlingly simple expedient. It has been found that if the abutting edges are generally located in their eventual positions and a flexible material is pulled through the join between them in the direction in which it is desired the pile should stand, then the pile may be brushed into proper position. Moreover, other detritus may be brushed away from the seam.

Thus the invention provides a method of forming a join between abutting edges of pile carpet, comprising: laying a composite tape comprising a cover tape and a base tape on a substrate along a line of abutment for the selected carpet edges; placing carpet pieces on the substrate in location for abutment of the selected respective edges; and removing at least sections of the cover tape from the base tape to pass between the selected edges to brush the pile of the carpet in the removal direction. Usually, the removal direction has at least a substantial upward vector which may aid in the provision of properly upstanding pile in the laid carpet. Preferably the base tape is one part of a hook and loop fastening system for the carpet.

The invention may be of use in locating discrete areas of removable carpet, e.g. areas of carpet which may be made replacable in regions of heavy wear, for example, as described and claimed in copending patent application Ser. No. 663,007 of the same applicant filed on even date herewith. Thus, one selected edge may comprise the perimeter edge of a first carpet piece and the other selected edge may comprise the perimeter edge of a cut out in another carpet piece, the perimeter edge of the first carpet piece and the perimeter edge of the cut out being adapted to register one with the other.

The cover tape need not be pulled through the seam all at once but different sections at spaced intervals along the length of the base tape may be pulled through as desired. Thus a portion of pattern, say at one end of the composite tape may be accurately matched for the carpet pieces and the cover tape for that portion may be pulled through the seam to make the hook and loop fastening. Thereafter a similar procedure may be followed for the other end of the composite tape or, indeed, any selected intermediate portion. Finally, having fixed key sections of carpet, the remaining lengths of cover tape may be quickly and easily removed.

The base tapes may have an upper surface comprising a hooked portion of a hook and loop attachment system for the carpet and the carpet includes a looped lower surface from which resilient loops protrude, the profile of said looped surface differing for different thicknesses of the discrete base tapes. The differing profiles required may, of course, be achieved by other means.

An additional feature of the invention is the use of cover tape having a central longitudinal core thread which forms the apex of a sharp fold in the tape as it is pulled through the carpet seam. Such thread may aid in the provision of a knife edge in the tape and resulting precision of the seam and/or it may aid in providing the necessary strength to the cover tape. It may be possible to use less robust cover tapes when such a pull thread is incorporated. The provision of less robust cover tapes may itself be advantageous since the seam may be less disturbed during laying without loss of pile brushing function.

The carpet may be any pile carpet. The half of the fastening system on the lower surface of the carpet may be the looped half and the carpet pile may be looped pile. In this case, if the looped half of the fastening system is made of suitable material for wear and decoration, the carpet may be reversible. This may be useful where the carpet is to fit into a cut out area so that it may be reversed when it becomes worn. It may include a resilient layer between its upper surface and the half of the hook and loop attachment system.

BRIEF DESCRIPTION OF THE DRAWINGS

Embodiments of the invention will now be described by way of example with reference to the drawings, in which.

DETAILED DESCRIPTION OF THE PREFERRED EMBODIMENTS

Figure 1:
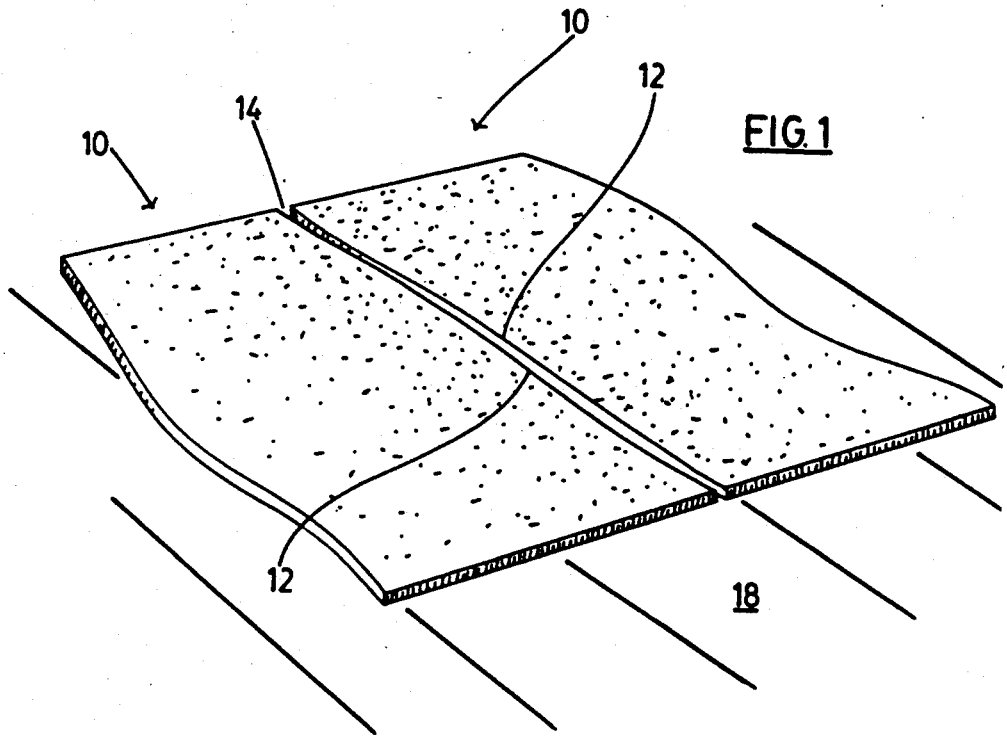
FIG. 1 is a diagrammatic sketch of a stage in the laying of carpet pieces having abutting edges according to the invention.
Figure 2:
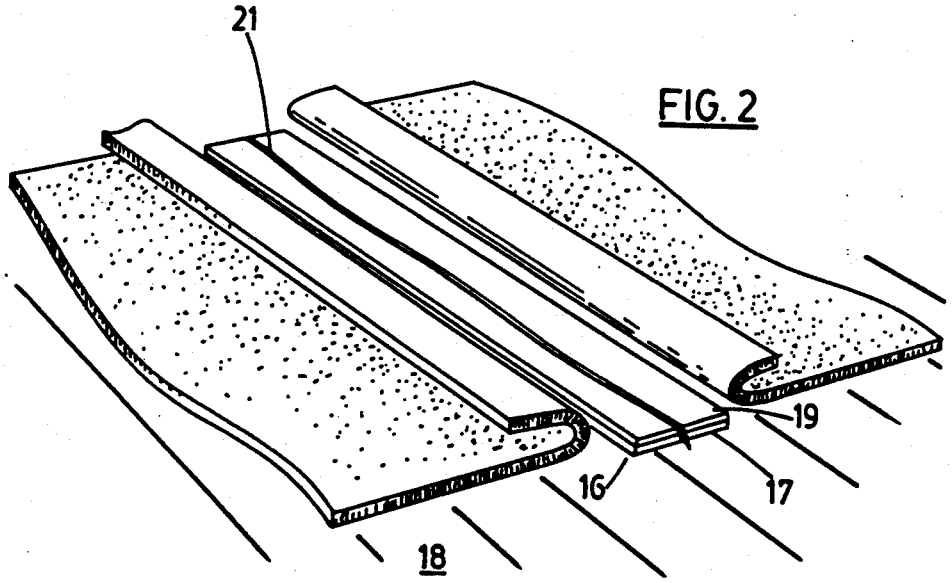
FIG. 2 is a later stage of one carpet laying process.
Figure 3:
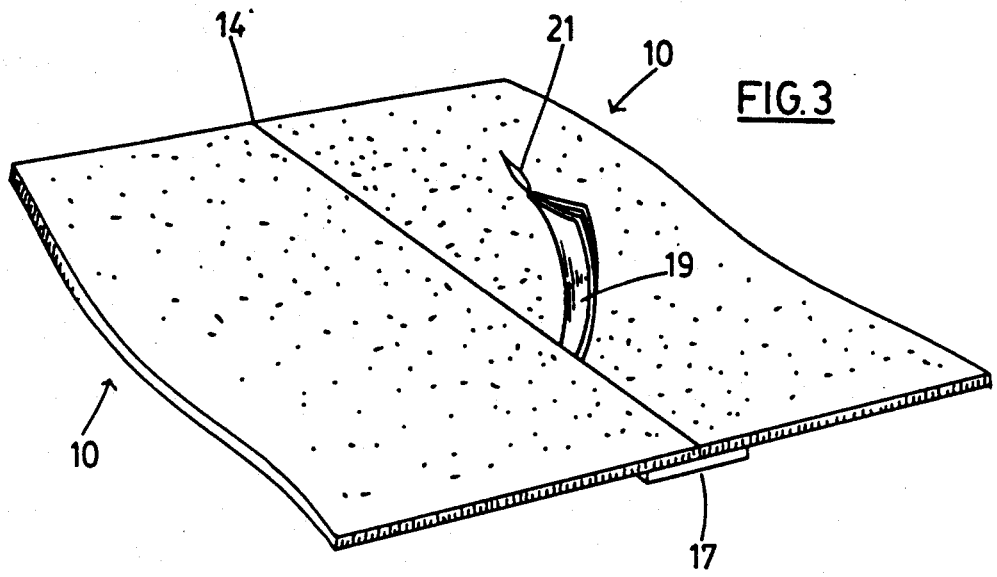
FIG. 3 is a later stage showing the tape being withdrawn between the carpet edges.

FIGS. 1 to 3 show steps in the laying of the carpet according to the invention. The carpet pieces 10 which are to be laid with edges 12 abutting at a seam 14, are located in position for the abutment of edges 12 over composite fixing tape 16.

Fixing tape 16 may comprise a two layer tape of which the lower layer 17 is a double surface adhesive tape for attachment to the substrate 18 through its lower surface. Its upper adhesive surface may be initially protected by the upper layer of cover tape 19 which cover tape 19 acts as brushing tape and which may include a central longitudinal core of thin thread 21. The thread 21 is of stronger construction than the cover tape 19 and may help form a strong sharp edge as the cover tape 19 is pulled through the carpet seam. If it is desired that seam 14 have a specific location, then it may be desirable to lay tape 16 on the substrate 18 prior to arranging the carpet pieces. Thus, tape 16 may be used as a guide for location of the carpet pieces 10. In fact, if thread 21 is a contrasting colour, it may be used as a more precise guide. Alternatively, but less likely, it may be convenient to first lay the carpet pieces loosely and, thereafter, fold back the edges 12 as shown in FIG. 2 so that composite tape 16 may be laid on the substrate 18 along the seam line 14, the line of which is defined by the abutment of edges 12.

Figure 4:
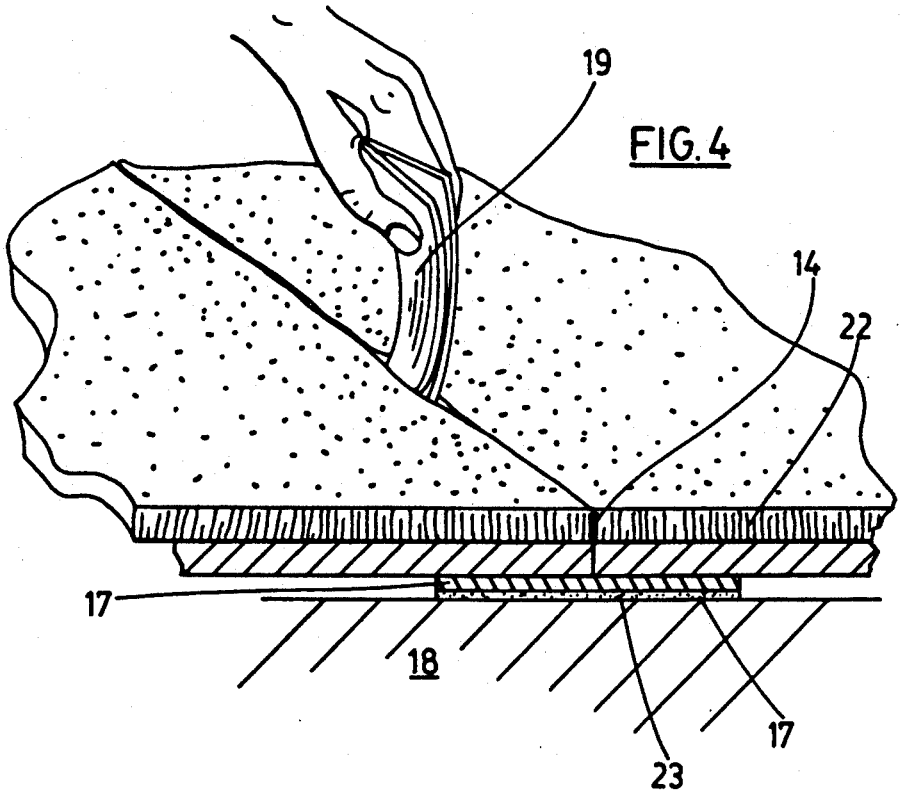
FIG. 4 is a detail of the seam during the process of FIG. 3 showing the upward brushing action of the tape.

FIG. 1 shows the initially loose laid carpet pieces 10 having abutting edges 12 covering composite tape 16, the imperfections of the seam 14 being exaggerated for the purpose of illustration. FIG. 2 shows the edges 12 folded back and composite tape 16 positioned on the substrate 18. This step is only necessary when the tape 16 is not pre-laid. FIG. 3 shows the edges 12 repositioned in their abutment position along seam 14 and shows brushing cover tape 19 being pulled upwardly in the direction of the arrow A to brush the pile 22 upwardly as the cover tape is withdrawn. The brushing upward action of the cover tape 19 may be seen from FIG. 4 which shows the flanges 20 of the cover tape bearing against the pile 22 to pull it upwardly with the cover tape 19 as it is withdrawn through the seam 14.

The characteristics of the brushing cover tape 19 itself are of importance in the invention. The tape should be sufficiently strong to be pulled through the seam without damage to the tape. Where a very heavy carpet, or a shag carpet, is involved, the strength of the cover tape may have to be greater than when a very light carpet is involved. Moreover, the width of the cover tape 19 is of appreciable significance where long pile or shag pile is used. For example, if a single strand of shag pile is initially bent fully under the edge of the carpet, it will be necessary to pull that full length of pile upwardly through the seam. It is envisaged that, for this purpose, the half width of the tape 19 should be at least as great as the length of the pile 22. Where short pile carpets are involved the half width of the tape may be appreciably greater than the length of the pile to minimize the necessary accuracy required in laying the tape along the exact seam line.

Provided that the strength of the brushing tape 19 is suitably considered, any of the large variety of flexible tapes which are available may be used.

Suitable materials for the brushing cover tape 19 which may be specifically mentioned are as follows:

synthetic or natural fibre fabrics, paper such as recycled paper, plastics materials such as nylon or polyesters. Inexpensive materials are to be preferred for economic reasons and recycled paper may be especially suitable.

Although there is no theoretical reason that the composite tape should not be a loose laid on the substrate, there may be a risk of displacement when the edges 12 of the carpet are abutted. It is, therefore, desirable that the tape 19 is lightly held against the lower carpet attaching tape 17 to guard against such displacement. It may be held in such a manner by adhesive, as in the double sided adhesive lower tape 17 as illustrated. However, other methods of holding the composite tape 16 to the substrate and for holding the cover tape 19 to the lower layer 17 are possible.

Figure 5:
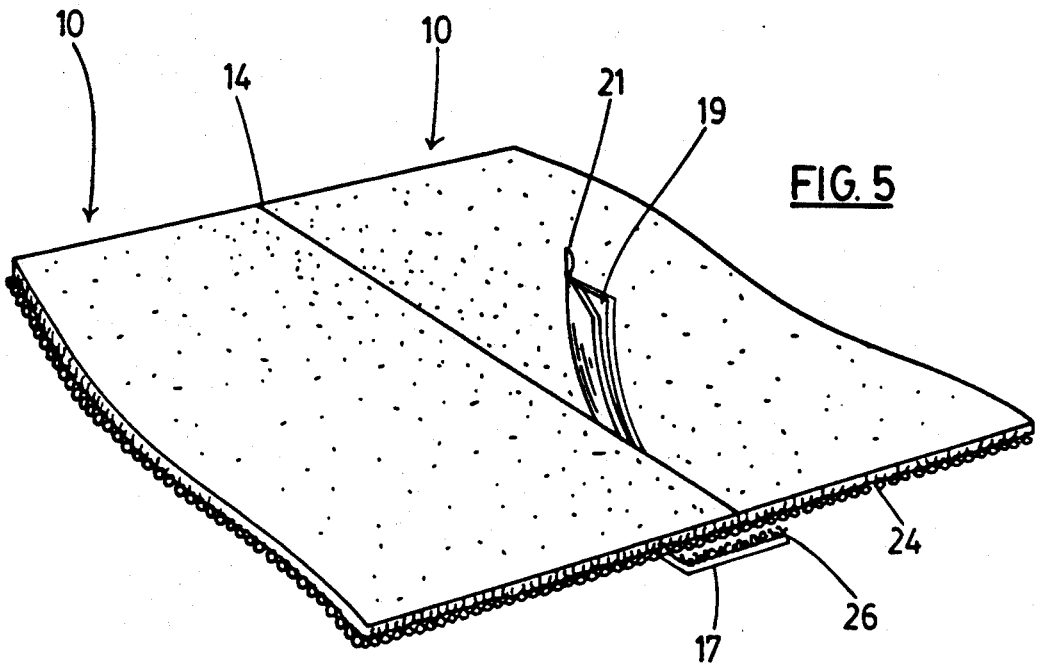
FIG. 5 shows a modification of FIG. 3 where the tape is a protective top tape for a hook and loop fastening system.

Especially suitable is the arrangement illustrated in FIG. 5. In this case, the carpet pieces 10 may be laid in accordance with the carpet system of U.S. Pat. No. 4,822,658 previously mentioned. In this case, the lower surface of the carpet pieces 10 comprises the looped half 24 of a hook and loop fastening system, the hook half 26 of which is located on a carpet attaching tape 17 in place of the adhesive of the tape 17 of FIGS. 1 to 3. The pile brushing cover tape 19 may suitably be protective tape which is located above the upper surface of the carpet attaching tape 17 to prevent premature engagement of the hooked half 26 with the looped half 24, or with temporarily adjacent pile 22, during various movements of the carpet. The carpet attaching tape may be fixed with respect to the substrate 18 by means set out in U.S. Pat. No. 4,822,658.

The pile brushing cover tape 19 may be attached to the hooked surface 26 of carpet attaching tape 17 by any suitable means. Light adhesive 23 is possible or a felted lower surface which provides some adhesion with the hooked half 26 is also possible. Other means of attachment may also be useful. It may even be possible to provide pile brushing tape 19 with a looped lower surface for full engagement with the hooked half 26 but this may be an unnecessarily costly possibility and, moreover such engagement may be unduly strong resulting in the expenditure of a considerable physical strength in pulling the pile brushing tape 19 through the seam 14.

Due to the facility for making an extremely neat seam between two abutting edges of carpet, a feature of the invention includes replacing panels of carpet where desirable. The carpet may originally be supplied having a cut out area where regions of exceptional heavy wear are expected as described and claimed in copending application No. Ser. No. 663,007 previously referred to. In this case, a panel 30 fitting into the cut out area will also be provided. This panel may be of similar carpet or of heavier duty carpet. It may be of matching pattern or of a contrasting colour or pattern. More than one such panel may be provided with the original carpet or may be provided later as an accessory.

Figure 6:
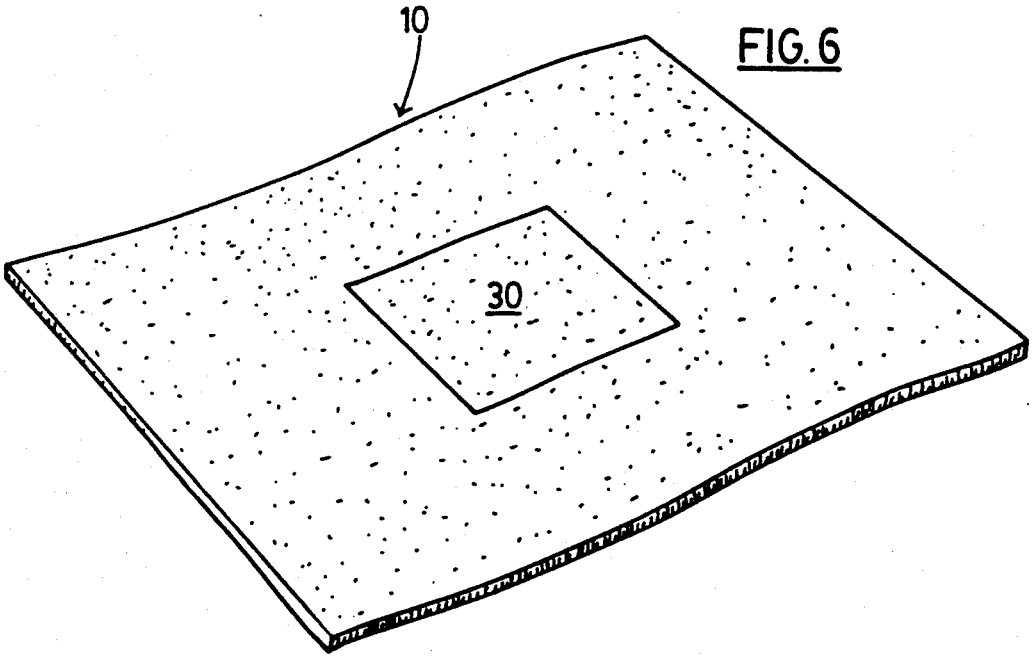
FIG. 6 shows a carpet piece having a replaceable area which may be seamed according to the invention.
Figure 7:
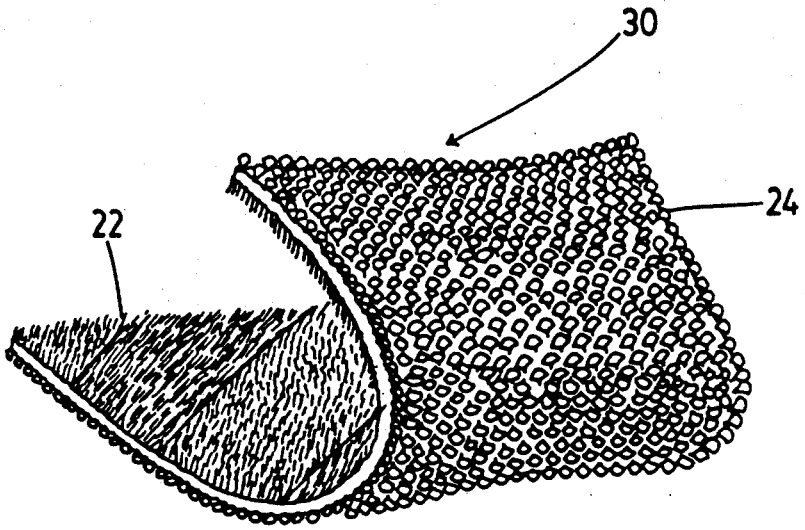
FIG. 7 is a diagrammatic cross-section of a reversible carpet which may be used.

The possibility of reversible replacement as shown in FIGS. 6 and 7, of panels 30 is also contemplated. These may be especially suitable where the carpet attachment to the substrate is by means of hook and loop fastening. The underside of the carpet, which is a looped half of the hook and loop fastening, may suitably be provided of a material and with a decorative finish to make it suitable as pile should the carpet piece be reversed. It should be noted in this connection that the looped half 24 of the carpet piece should be of sufficient resilience to prevent it being pulled through the seam with the pile brushing tape 16 when the tape is pulled through the seam. If the looped half 24 is displacable sufficiently to impair the seam 14 some of the advantages of the invention will be lost. Nevertheless, even when this is the case, the upward brushing of the carpet pile may act to hide any such defects and is, in itself, advantageous. Considerations in this instance are largely a matter of common sense.

Clearly, a shag pile carpet piece may not be suitable for reversing, whereas a woven or looped upper surface with no, or no appreciable, pile may be especially suitable for reversing.

I claim:

1. A method of forming a seam between abutting edges of pile carpet wherein the carpet edges are attached to a base tape, comprising:

laying a composite tape comprising a cover tape and a base tape on a substrate along a line of abutment for selected carpet edges wherein the cover tape is wider than the line of abutment;

placing carpet pieces on the substrate in location for abutment of selected respective edges; and attaching the carpet edges to the base tape by removing at least sections of the cover tape from the base tape wherein the cover tape passes between the selected edges, brushes the pile of the carpet in the removal direction and pulls down-turned pile upwardly through the seam.

2. A method as claimed in claim 1 in which the base tape is one part of a hook and loop fastening system for the carpet.

3. A method as claimed in claim 1 in which one selected edge comprises the perimeter edge of a first carpet piece and the other selected edge comprises the perimeter edge of a cut out in another carpet piece, the perimeter edge of the first carpet piece and the perimeter edge of the cut out being adapted to register one with the other.

4. A method as claimed in claim 2 in which sections of cover tape are removed in selected order for a corresponding selected order of attachment of abutting carpet edges to allow for accurate pattern matching.

5. A method as claimed in claim 1 in which the base tape comprises a plurality of separate tapes of different thicknesses preselected to match deviations selected from carpet thickness deviations and deviations and in evenness of substrate.

6. A method as claimed in claim 5 in which the separate tapes comprise a hooked portion of a hook and loop attachment system for the carpet which includes a looped lower surface of which resilient loops protrude, the profile of the surface of the looped portions differing for different thicknesses of the separate tapes.

7. A method as claimed in claim 6 in which the carpet has a looped lower surface.

8. A method as claimed in claim 7 in which the carpet has looped pile.

9. A method as claimed in claim 8 in which the carpet is reversible.

10. A method as claimed in claim 2 in which the carpet includes a resilient layer between its upper surface and the half of the hook and loop attachment system.

11. A method as claimed in claim 1 in which the cover tape includes a longitudinal core thread about which the tape forms a sharp crease as it is pulled between the selected carpet edges.

12. A method as claimed in claim 1 in which the cover tape comprises recycled paper.

13. A method as claimed in claim 1 wherein the cover tape comprises synthetic or natural fibre fabrics.

* * * * *